United States Patent [19]

Sato

[11] Patent Number: 4,809,037

[45] Date of Patent: Feb. 28, 1989

[54] COLOR IMAGE RECORDER RECORDING DIFFERENT COLORS WITH DIFFERENT RECORDING UNITS AND PREVENTING RECORDING OPERATION IN THE CASE OF IMPROPER COLOR BALANCE

[75] Inventor: Yukio Sato, Kawasaki, Japan

[73] Assignee: Canon Kabushiki Kaisha, Tokyo, Japan

[21] Appl. No.: 861,872

[22] Filed: May 12, 1986

[30] Foreign Application Priority Data

May 17, 1985 [JP] Japan ..... 60-104059
May 17, 1985 [JP] Japan ..... 60-104060
May 17, 1985 [JP] Japan ..... 60-104061

[51] Int. Cl.[4] ..... G03G 15/01

[52] U.S. Cl. ..... 355/4; 355/14 CH; 346/157

[58] Field of Search ..... 355/4, 14 R, 14 CH, 355/14 E, 14 D; 346/157, 160; 358/75, 300, 78

[56] References Cited

U.S. PATENT DOCUMENTS 4,408,871 11/1983 Kajima ..... 358/300 X
4,583,834 4/1986 Seko et al. ..... 355/14 R X
4,587,536 5/1986 Saito et al. ..... 355/4 X

FOREIGN PATENT DOCUMENTS 57-116360 7/1982 Japan ..... 355/14 CH
59-79264 5/1984 Japan ..... 355/4

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A color image recorder in which different colors are recorded with different recording units is provided with detectors for detecting the recording status or surface potential of the photosensitive members of the recording units, and prohibiting the recording operation in case good color balance cannot be obtained due to inadequate potential.

14 Claims, 10 Drawing Sheets

COLOR IMAGE RECORDER RECORDING DIFFERENT COLORS WITH DIFFERENT RECORDING UNITS AND PREVENTING RECORDING OPERATION IN THE CASE OF IMPROPER COLOR BALANCE

BACKGROUND OF THE INVENTION

1. Field of the Invention

The present invention relates to an image forming apparatus for forming an image on a recording sheet, and in particular to an image forming apparatus provided with plural recording units.

2. Related Background Art

In the field of image forming apparatus there is already known a color copying machine employing a photosensitive drum and capable of obtaining a color image by effecting three exposures for an original and employing color developers of yellow (Y), magenta (M) and cyan (C). However such apparatus inevitably becomes large.

For size reduction, therefore, there is proposed a color copying machine employing plural drums, for example four drums.

In case of a one-drum system, there is generally employed a control unit for controlling the surface potential of the photosensitive drum, so that the photosensitive characteristic of said photosensitive drum is uniform for three exposures for different color components.

On the other hand, in case of a four-drum system, a satisfactory balance of the obtained color image is difficult to achieve since four drums have respectively different characteristics.

SUMMARY OF THE INVENTION

In consideration of the foregoing, an object of the present invention is to provide an improved image forming apparatus.

One aspect of the present invention resides in the provision of an image forming apparatus capable of maintaining satisfactory color balance.

Another aspect of the present invention resides in improving the operability of an image forming apparatus provided with plural image recording units of respectively different colors.

According to still another aspect of the present invention formation of an inadequate color image in an image forming apparatus provided with plural image recording units of respectively different colors is prevented.

Still another aspect of the present invention enables image recording according to the priority of colors even in case of a failure in an image recording unit, in an image forming apparatus provided with plural image recording units of respectively different colors.

The foregoing and still other objects of the present invention will become fully apparent from the following description to be taken in conjunction with the attached drawings.

DETAILED DESCRIPTION OF THE PREFERRED EMBODIMENTS

Now the present invention will be explained in detail by embodiments thereof shown in the attached drawings.

At first there will be given an explanation on a one-drum color copying machine shown in FIG. 1, constituting a prior technology to the present invention.

Figure 1:
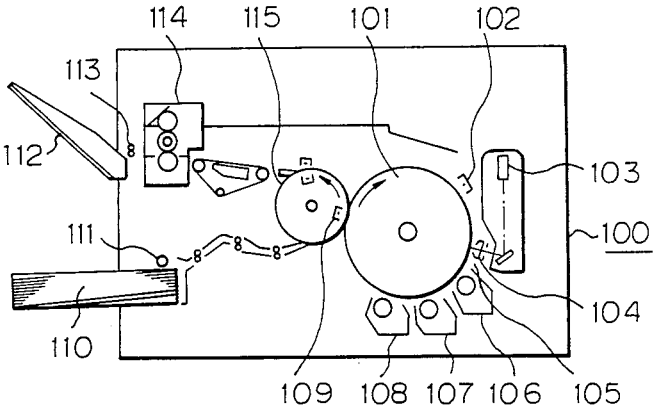
Fig. 1 PRIOR ART
FIG. 1 is a schematic view of a color copying machine with a drum.

In FIG. 1 illustrating a one-drum color copying machine 100, there are shown a photosensitive drum 101 rotated in a direction a; a charger 102; a laser unit 103, an exposure charger 104; a surface potential sensor 105; and color developing units 106, 107 and 108 of yellow (Y), magenta (M) and cyan (C).

The above-explained copying machine functions in the following manner. A photosensitive member on the periphery of rotating photosensitive drum 101 is charged by corona discharge from the charger 102. A laser beam emitted by the laser unit 103 irradiates the photosensitive drum 101 through a mirror. The laser unit is provided with an unrepresented polygonal mirror, which is rotated to deflect the laser beam in the main scanning direction, thus forming a scanning line. Said laser beam is turned on and off according to pixels to form an electrostatic latent image on the photosensitive member on the photosensitive drum 101. Said latent image is developed into a visible image by deposition of color toner in one of the three color developing units 106, 107 and 108, and the toner image thus obtained is transferred, by means of a transfer charger 109, onto a recording sheet 110 which is supplied from a sheet cassette by a feed roller 111. The present copying machine is different from ordinary black-and-white copying machines in that the recording sheet 110 is supported on a support drum 115 and is rotated in a direction b. Said support drum 115 is rotated at a speed same as the peripheral speed of the photosensitive drum 101, in order to receive color toner images in the order of yellow, magenta and cyan.

After the transfers of three original color toner images, the recording sheet is peeled from the support drum 115, and is transferred to a thermal fixing unit 114, and, after image fixation therein, is discharged to a copy tray 112 by means of discharge rollers 113.

The surface potential sensor 105 is provided for controlling the amount of charge on the photosensitive drum 101 and developing bias therefor, and an unrepresented potential control unit is provided for preventing deterioration in image quality.

The one-drum color copying machine as explained above is inevitably bulky. For example, in case of using a recording sheet of A3 size, the support drum 115 becomes inevitably very large, as the periphery thereof has to be as long as the longitudinal side of the A3 size. Also the structure is associated with a limitation that three developing units 106, 107, 108 have to be arranged side by side.

In the following there will be explained a color copying machine of the present invention which has resolved the above-explained drawbacks.

Figure 2:
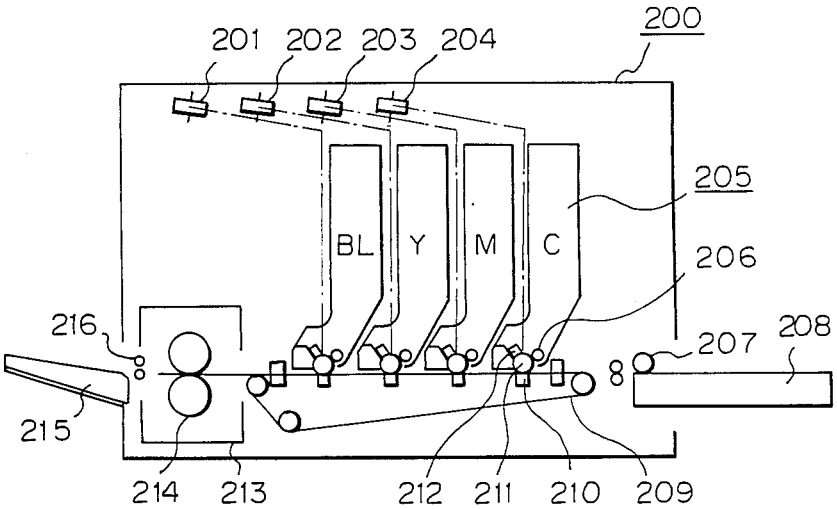
FIG. 2 is a schematic view of a color copying machine with four drums, constituting an embodiment of the present invention.

FIG. 2 shows a four-drum color copying machine or image forming apparatus 200 constituting an embodiment of the present invention. Said machine is composed of four units, each provided with a photosensitive drum. These units are mutually identical, but are different in the colors of toner contained in respective color developing units 205.

Laser units 201, 202, 203, 204 are provided respectively for color signals of black (BL), yellow (Y), magenta (M) and cyan (C). As already explained in relation to FIG. 1, each laser unit is provided with an unrepresented polygonal mirror which is rotated to deflect the laser beam in the main scanning direction to form a scanning line.

In each unit, a photosensitive drum 211 is rotated clockwise and is surfacially charged by a charger 212.

The laser beam is turned on and off to record image information. A latent image thus obtained is developed into a visible image by deposition of color toner from a developing sleeve 206, and a toner image obtained in this manner is transferred, by means of a transfer charger 210, onto a recording sheet which is supplied from a sheet cassette 208 by feed rollers 207.

The recording sheet is transported, by a conveyor belt 209 from a cyan color developing station to a succeeding magenta color developing station. In succession yellow and black toner images are superposed. When the toner images of four colors are superposed, the sheet is transferred to a thermal fixing unit 214, and the images are thermally fixed by fixing rollers 214. Then the sheet is discharged onto a copy tray 215 by discharge rollers 216.

In the one-drum color copying machine, employing only one photosensitive drum, eventual deterioration in image quality resulting for example from sensitivity loss of the photosensitive member similarly affects all the color developments of yellow, magenta and cyan. Consequently, color balance is maintained even in the presence of such deterioration. It is therefore possible to prevent the deterioration in image quality through surface potential control.

On the other hand, in the four-drum color copying machine, the deterioration in sensitivity proceeds differently in four drums. Also the color balance may be aberrated if one of the drums is replaced by a new one. Such drawbacks are overcome by the present invention.

Figure 3:
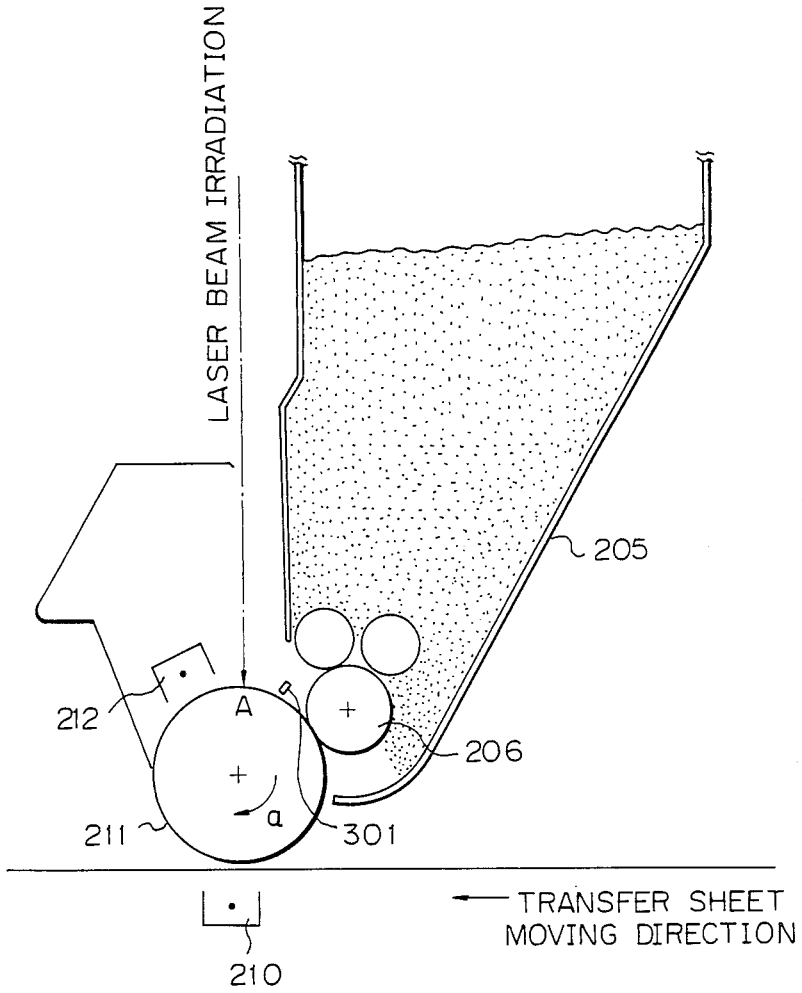
FIG. 3 is an enlarged view of the vicinity of a photosensitive drum shown in FIG. 2.
Figure 4:
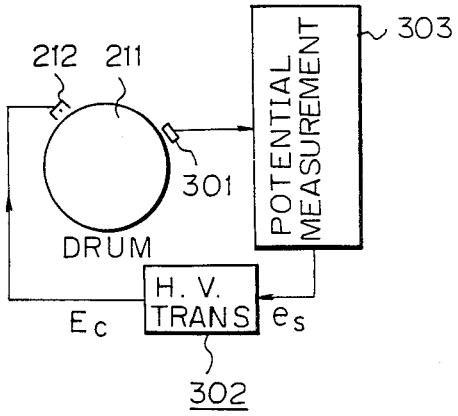
FIG. 4 is a block diagram of potential control means in the embodiment of the present invention shown in FIG. 2.

FIG. 3 is an enlarged view of the vicinity of the photosensitive drum 211 of a unit, and FIG. 4 is a block diagram of a circuit for surface potential measurement and control. As shown in FIG. 3, detecting means constituted by a potential sensor 301 is provided for measuring a recording condition such as the surface potential of the photosensitive drum 211.

Figure 5:
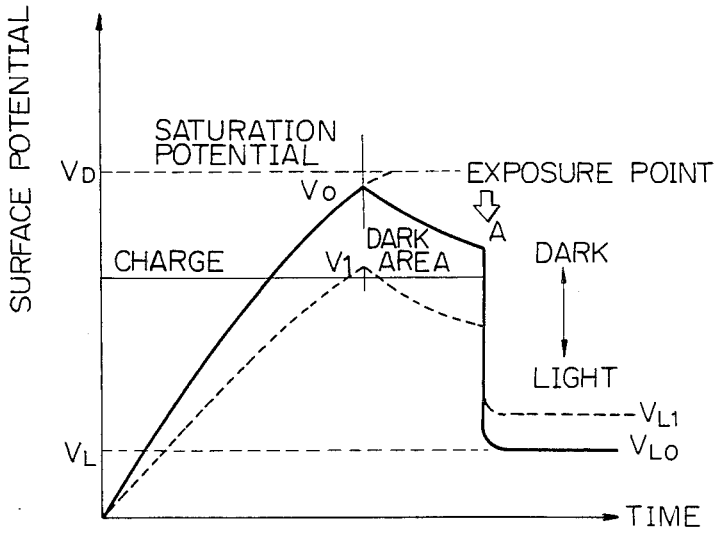
FIG. 5 is a chart showing time-dependent surface potential of the photosensitive drum shown in FIG. 2.

FIG. 5 shows the general behavior of the surface potential of a photosensitive drum. The drum is charged, by corona discharge of the charger 212, to a surface potential V0, which is then subjected to a dark decay to an exposure point A. Said point corresponds to the point of laser beam irradiation A shown in FIG. 3. The surface potential varies according to the amount of exposure, or the intensity of laser beam. In case of analog recording, the density of the recorded image can be varied by the intensity of the laser beam, but such variation is not required in the present embodiment which deals with digital recording only.

In FIG. 4 there is provided a high-voltage transformer circuit 302, through which the surface potential of the drum is controlled in response to the measurement with the potential sensor 301. The sensitivity of the drum can be identified by measuring the surface potential thereof, after the drum is irradiated with the laser beam of a determined diameter an d of a determined power.

It is assumed that the surface potential measured by the potential sensor 301 after irradiation with a determined laser beam intensity is equal to $V_{L0}$. This is a target value, and the actually measured value may be as high as $V_{L1}$, thus narrowing the dynamic range. Such phenomenon may be caused by the deterioration of the photosensitive drum 211, or by deficiency in exposure, resulting from an insufficient laser power. In this case, however, the deterioration of the photosensitive drum 211 should be the principal cause since the laser power is maintained constant.

In order to overcome such drawback the charging control voltage Ec for driving the charger 212 may be reduced. On the other hand, if the surface potential is lower than the target value, said voltage Ec may be increased.

Figure 6:
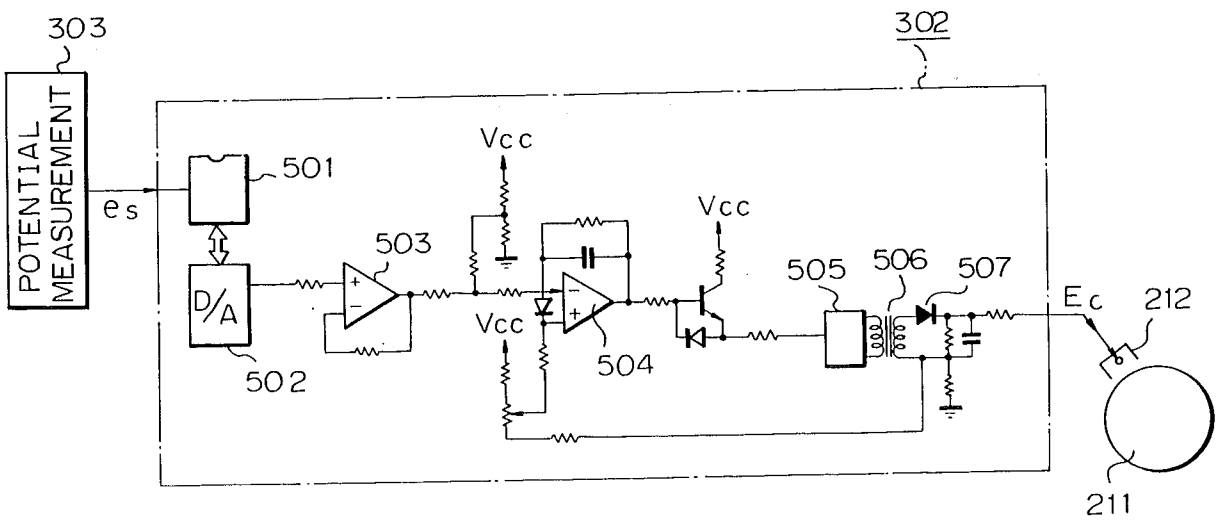
FIG. 6 is a block diagram showing a detailed example of the circuit shown in FIG. 4.
Figure 7:
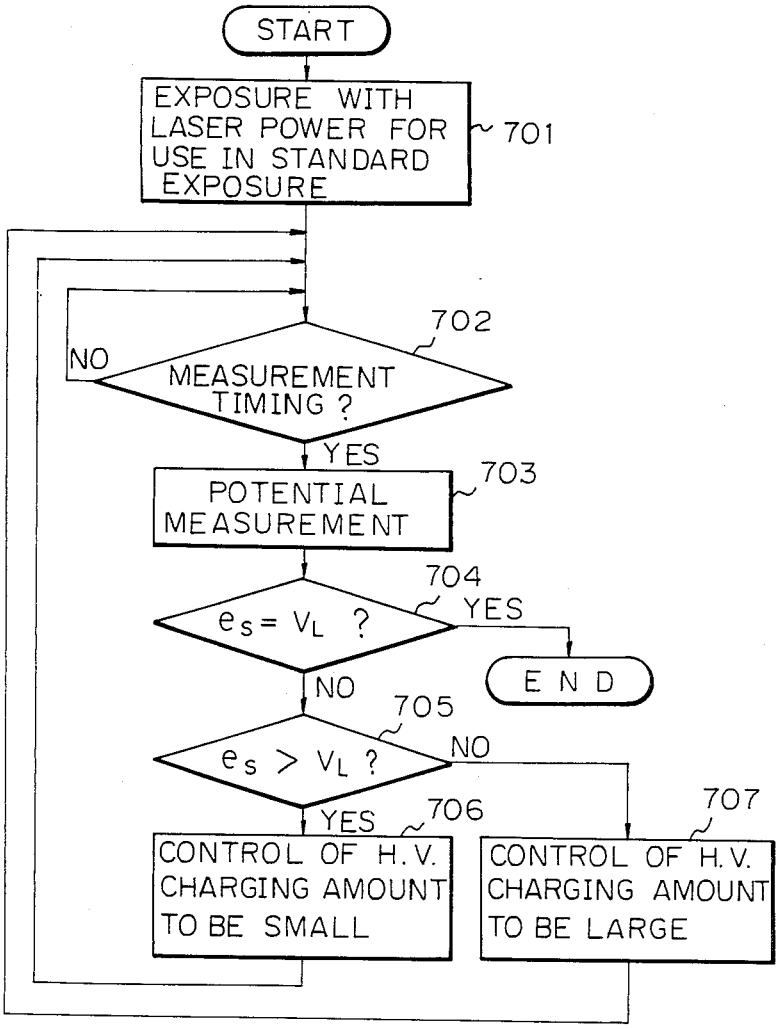
FIGS. 7, 9 and 11 are flow charts showing the control procedure in the embodiment of the present invention.

FIG. 6 shows a detailed example of the highvoltage control unit 302 shown in FIG. 4, utilizing a microcomputer 501 for executing a flow chart shown in FIG. 7, and a digital-to-analog converter 502.

The analog output signal of said D/A converter 502 is amplified by an amplifier 503 and is supplied to the inverted input terminal of a comparator 504, which controls the difference between a feedback value of the high-voltage output and the target value.

A high-frequency oscillator 505, a pulse transformer 506 and a high-voltage diode 507 constitutes a DC-DC converter, of which output is supplied as the charging control voltage Ec for driving the charger 212.

Now reference is made to FIG. 7 for explaining the performance of the above-explained circuit.

At first a laser power for standard exposure is supplied, and the corresponding laser beam irradiates the photosensitive drum 212 to generate a surface potential thereon (step 701).

Subsequently the surface potential is measured, in consideration of the distance between the charger 212 and the potential sensor 301. For this purpose the timing of measurement is determined by a potential measuring instruction from the microcomputer 501 (step 702), and the potential measured by the sensor 301 is fetched (step 703).

Subsequently there is discriminated whether the potential $e_s$ measured in the step 703 is equal to (or, in practice, within a tolerance from) the target value $V_L$ (step 704), and, if affirmative, the potential detection and the voltage control for the charger 212 are terminated since the potential of the photosensitive member of this unit is acceptable for obtaining a satisfactory color balance.

However, in case said discrimination in the step 704 turns out as negative ($es \neq V_L$), the program proceeds to a step 705 to identify if said measured potential es is higher than the target value $V_L$. If affirmative ($es > V_L$), control is so executed as to reduce the amount of charging (step 706). This is achieved, in the high-voltage transformer circuit 302, by reducing the digital voltage, supplied from the microcomputer 501 to the D/A converter 502, by a determined amount, whereby the charging control voltage Ec released from said transformer circuit 302 is accordingly reduced.

On the other hand, in case the discrimination in the step 705 turns out negative ($es < V_L$), control is so executed as to increase the amount of high-voltage charging (step 707). This is achieved by increasing the digital voltage, supplied from the microcomputer 501 to the D/A converter 502, by a determined amount, thereby accordingly increasing the charging control voltage Ec released from the high-voltage transformer circuit 302.

After the charging control voltage Ec is regulated according to the comparison of the measured potential es and the target value $V_L$ (steps 706, 707), the program returns to the step 702 to repeat the measurement of potential es and the control of charging control voltage es.

When the measured potential es becomes equal to the target value $V_L$ in the foregoing loop procedure, the step 704 provides the affirmative discrimination to terminate said loop procedure.

The surface potential of a photosensitive drum 211 is controlled in this manner, but the sensitivity characteristic of the drum 211 is not constant as explained before. Consequently, in the present embodiment utilizing four drums, the sensitivity characteristics thereof have to be mutually balanced.

Figure 8:
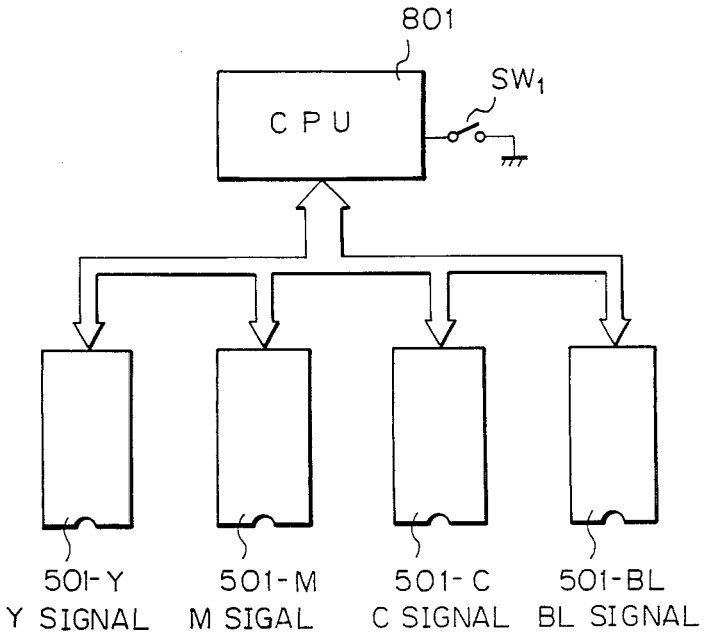
FIG. 8 is a block diagram showing relation between a central processing unit and four charge control microcomputers in the embodiment of the present invention.

For this purpose there is conducted exchange of data for measurement and control of potential, as shown in FIG. 8, among a central processing unit 801 composed of a CPU, and microcomputers 501-Y, 501-M, 501-C and 501-BL of the high-voltage transformer circuits 302 of four units. More specifically, since each photosensitive drum 211 shows time-dependent fluctuation in characteristics, the central processing unit 801 collects the data of measured potentials from the microcomputers and provides control data matching each photosensitive drum. In this manner it is rendered possible to overcome the trouble in color balance, resulting from unbalance in characteristics of the photosensitive drums.

As explained in the foregoing, a satisfactory color balance can be maintained with plural photosensitive members, by individually measuring the potentials thereof and collectively controlling the potentials.

Figure 9:
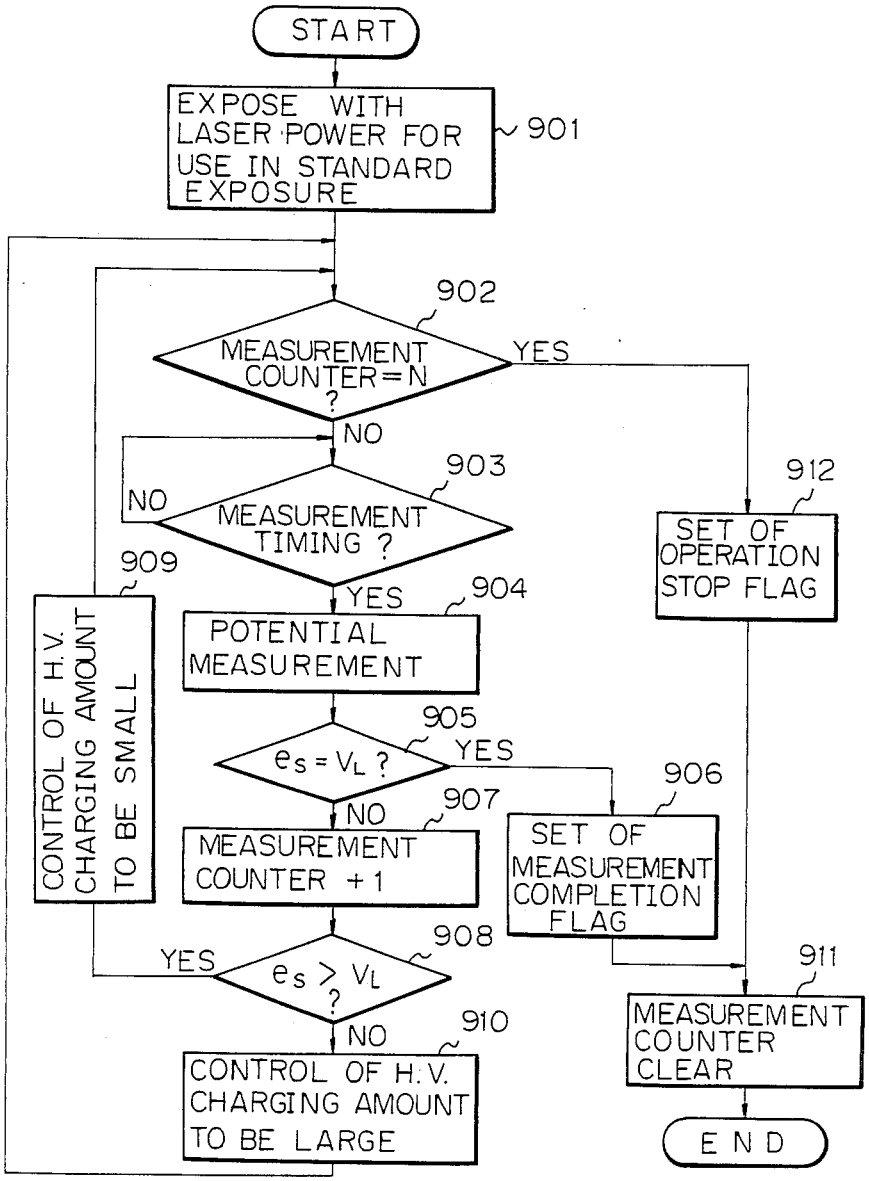

It is also possible to interrupt the image forming operation in case an abnormality in color balance is identified at least in one of the photosensitive means. Such embodiment will be explained in relation to FIG. 9.

At first a laser power for standard exposure is supplied, and the corresponding laser beam irradiates the photosensitive drum 212 to generate a surface potential thereon (step 901).

Then there is identified whether the number of potential measurements to be executed in the succeeding steps has reached a number N (step 902). Said number is initially set at "0" by an unrepresented step.

If said identification turns out negative (said number being not N), the surface potential is measured, in consideration of the distance between the charger 212 and the potential sensor 301. For this purpose the timing of measurement is determined by a potential measuring instruction from the microcomputer 501 (step 903), and the potential measured by the sensor 301 is fetched (step 904).

Subsequently there is discriminated whether the potential es measured in the step 904 is equal to (or, in practice, within a tolerance from) the target value $V_L$ (step 905), and, if affirmative, a measurement completion flag is set (step 906) in order to terminate the potential measurement and the voltage control for the charger 212 since the potential of the photosensitive member of this unit is acceptable for obtaining a satisfactory color balance.

However, in case said discrimination in the step 905 turns out negative ($es \neq V_L$), the program proceeds to a step 907 for a stepwise increment of the number of measurements. Subsequently there is discriminated whether the measured potential es is higher than the target value $V_L$ (step 908), and, if affirmative ($es > V_L$), control is so executed as to reduce the amount of charging (step 909). This is achieved, in the high-voltage transformer circuit 302, by reducing the digital voltage, supplied from the microcomputer 501 to the D/A converter 502, by a determined amount, whereby the charging control voltage Ec released from said transformer circuit 302 is accordingly reduced.

On the other hand, in case the discrimination in the step 908 turns out negative ($es < V_L$), control is so executed as to increase the amount of high-voltage charging (step 910). This is achieved by increasing the digital voltage, supplied from the microcomputer 501 to the D/A converter 502, by a determined amount, thereby accordingly increasing the charging control voltage Ec released from said high-voltage transformer circuit 302.

After the charging control voltage Ec is regulated according to the comparison of the measured potential es and the target value $V_L$ (steps 909, 910), the program returns to the step 920 to repeat the measurement of potential es and the control of charging control voltage Es.

When the measured potential es becomes equal to the target value $V_L$ in the foregoing loop procedure, the step 905 provides the affirmative discrimination to terminate said loop procedure.

The deterioration of the photosensitive drum 211 can be detected by counting the number of potential controls. The result of potential measurement is used for feedback for high-voltage control (cf. steps 909, 910), but in certain cases the control is impossible regardless of the number of such feedbacks. Thus the deterioration of the photosensitive drum 211 can be identified by limiting the number of repetition to N. For this purpose, if the step 902 provides an affirmative result, indicating that the number of measurements has reached N and that the image quality has not been improved by an abnormality, an operation stop flag is set (step 912), then a measurement counter is cleared (step 911) and the copying operation is terminated.

The surface potential of a photosensitive drum 211 is controlled in this manner, but the sensitivity characteristic of the drum 211 is not constant as explained before. Consequently, in the present embodiment utilizing four drums, the sensitivity characteristics thereof have to be mutually balanced.

Figure 10:
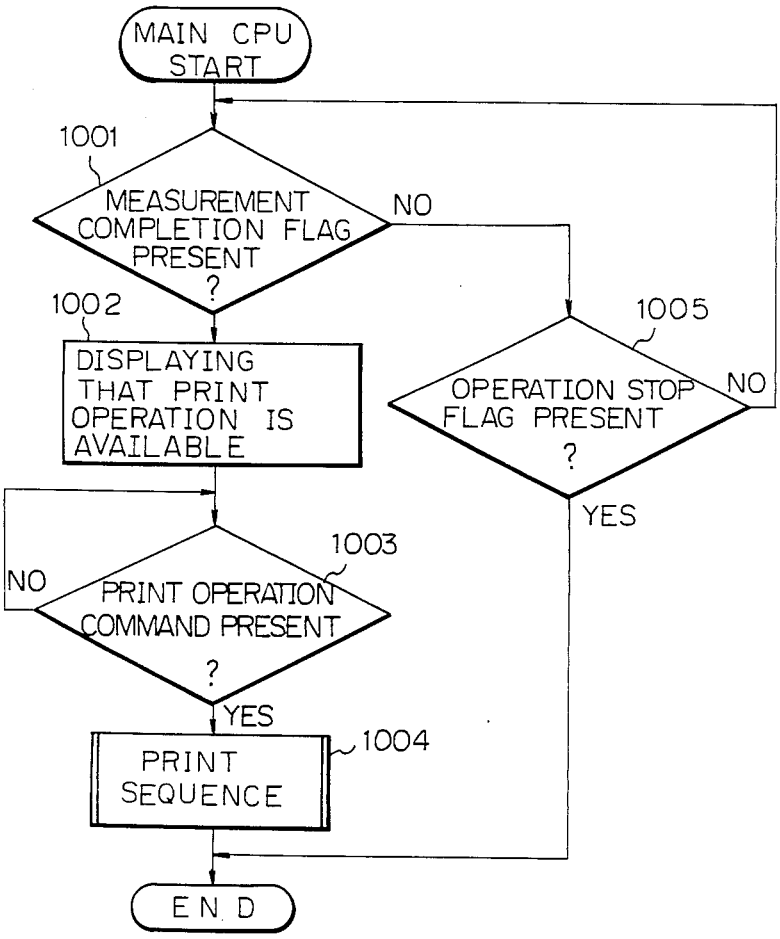
FIGS. 10 and 12 are flow charts showing the control procedure by central processing unit shown in FIG. 8.

Now reference is made to FIG. 10. showing the flow chart of the main CPU of the present embodiment shown in FIG. 8.

At first a step 1001 identifies whether the measurement completion flags are present for all the sub-CPU's 501-Y, 501-M, 501-C and 501-BL, and, in case of an affirmative identification, a step 1002 provides a display that the printing operation is possible. When the operator enters a printing instruction in a step 1003, a print sequence is initiated in a step 1004. On the other hand, if any measurement completion flag is lacking in the step 1001, a step 1005 identifies the presence of the operation stop flag, and, in case of an affirmative identification, the sequence is immediately terminated to prohibit the printing operation. On the other hand, if the step 1005 provides a negative identification, indicating that the operation stop flag is absent, the program returns to the step 1001.

In this manner it is rendered possible to prevent image formation with aberrated color balance with plural photosensitive members, by individually measuring the potentials thereof and terminating the image forming operation in case any of the photosensitive members is identified as abnormal.

It is also possible, in case of an abnormality at least in one of plural photosensitive means, to identify whether a color image can be formed, according to the priority of color reproductions. Such embodiment will be explained in the following, with reference to FIG. 11.

At first a laser power for standard exposure is supplied, and the corresponding laser beam irradiates the photosensitive drum 211 to generate a surface potential thereon (step 1101).

Then there is identified whether the number of potential measurements to be executed in the succeeding steps has reached a number N (step 1102). Said number is initially set at "0" by an unrepresented step.

If said identification turns out negative (said number being not N), the surface potential is measured, in consideration of the distance between the charger 212 and the potential sensor 301. For this purpose the timing of measurement is determined by a potential measuring instruction from the microcomputer 501 (step 1103), and the potential measured by the sensor 301 is fetched (step 1104).

Subsequently there is discriminated whether the potential es measured in the step 1104 is equal to (or, in practice, within a tolerance from) the target value $V_L$ (step 1105), and, if affirmative, a measurement completion flag is set (step 1106) in order to terminate the potential measurement and the voltage control for the charger 212 since the potential of the photosensitive member of this unit is acceptable for obtaining a satisfactory color balance.

However, in case said discrimination in the step 1105 turns out negative ($es \neq V_L$), the program proceeds to a step 1107 for a stepwise increment of the number of measurements. Subsequently there is discriminated whether the measured potential es is higher than the target value $V_L$ (step 1108), and, if affirmative ($es > V_L$), control is so executed as to reduce the amount of charging (step 1109). This is achieved, in the high-voltage transformer circuit 302, by reducing the digital voltage, supplied from the microcomputer 501 to the D/A converter 502, by a determined amount, whereby the charging control voltage Ec released from said transformer circuit 302 is accordingly reduced.

On the other hand, in case the discrimination in the step 1108 turns out negative ($es < V_L$), control is so executed as to increase the amount of high-voltage charging (step 1110). This is achieved by increasing the digital voltage, supplied from the microcomputer 501 to the D/A converter 502, by a determined amount, thereby accordingly increasing the charging control voltage Ec released from said high-voltage transformer circuit 302.

After the charging control voltage Ec is regulated according to the comparison of the measured potential es and the target value $V_L$ (steps 1109, 1110), the program returns to the step 1102 to repeat the measurement of potential es and the control of charging control voltage Es.

When the measured potential es becomes equal to the target value $V_L$ in the foregoing loop procedure, the step 1105 provides the affirmative discrimination to terminate said loop procedure. Then, after the step 1106, the count for measurements is cleared (step 1111) and the operation is terminated.

The deterioration of the photosensitive drum 211 can be detected by counting the number of potential controls in the step 1107. The result of potential measurement is used for feedback for high-voltage control (cf. steps 1109, 1110), but in certain cases the control is impossible regardless of the number of such feedbacks. Thus the deterioration of the photosensitive drum 211 can be identified by limiting the number of repetition of N. For this purpose, if the step 1102 provides an affirmative result, indicating that the number of measurements has reached N and that the image quality has not been improved by an abnormality, an operation stop flag is set (step 1112), then the measurement counter is cleared (step 1111) and the copying operation is terminated.

In the present embodiment the state of deterioration of four photosensitive drums 211 is monitored, and, in case of deterioration in any drum, there is discriminated the possibility of color copying operation, according to the priority of the corresponding color signal.

Figure 12:
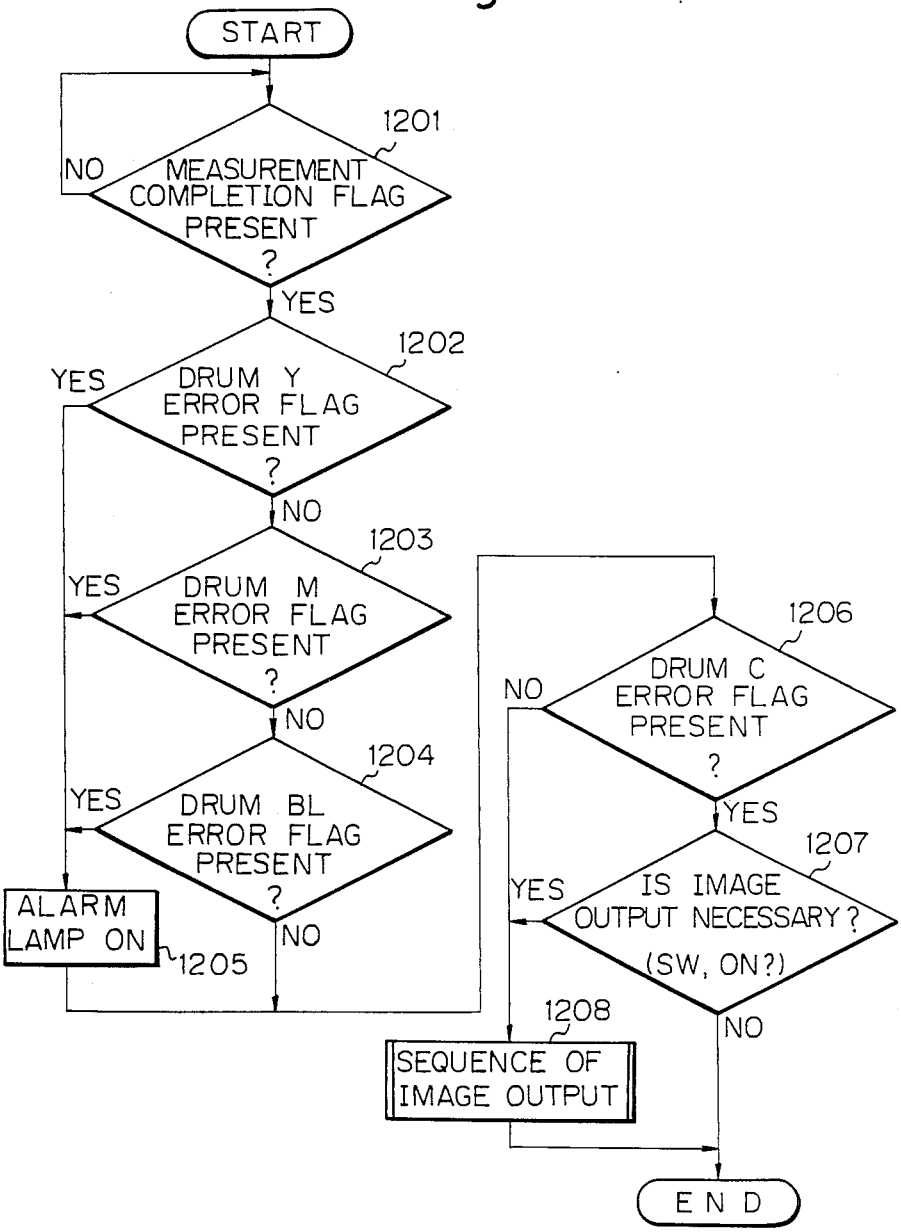

This procedure will be explained in the following, with reference to FIG. 12.

At first there is discriminated whether the measurement completion flag is set (step 1201), according to an instruction of the main CPU 801 shown in FIG. 8. In case of an affirmative discrimination, indicating that said flag has been set, there is discriminated whether an error flag for yellow signal is set (step 1202). In case of negative discrimination, there is discriminated the presence of error flags for magenta signal and black signal (steps 1203, 1204).

In case of an affirmative result, indicating the presence of an error flag, in any of the foregoing steps 1202–1204, a warning that an error in the color balance is given to the operator (step 1205).

Subsequently there is discriminated whether an error flag for cyan signal is set (step 1206), and, in case of an affirmative result, there is then discriminated whether a printout is required (step 1207). If not, the operation is terminated.

On the other hand, in case of a negative discrimination in the step 1206 or an affirmative discrimination in the step 1207, a printout sequence is executing (step 1208) to obtain a copy of the original.

As explained in the foregoing, in case of an abnormality in the yellow, magenta or black signal, a warning is provided (step 1205) but the copying operation remains enabled (step 1208). On the other hand, in case of an abnormality in the cyan signal, and, if the operator wished a copy despite of such abnormality (in case of affirmative result in the step 1207), the copying operation can be enabled by actuating a switch SW1 shown in FIG. 8 (step 1208).

Figure 11:
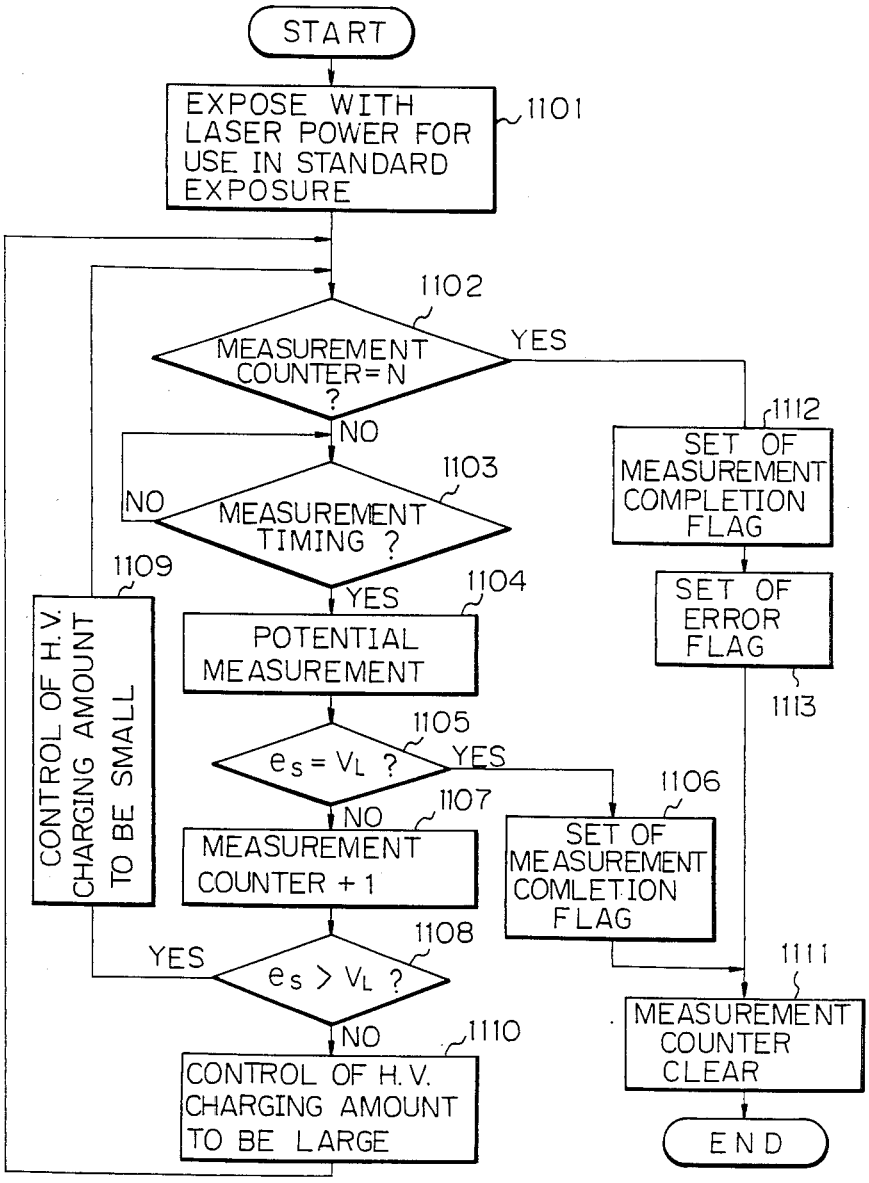

The measurement completion flag to be discriminated in the above-mentioned step 101 is set in the steps 1106, 1112 shown in FIG. 11. Also the error flags to be discriminated in the steps 1202–1204 and 1206 are set in the step 1213 shown in FIG. 11.

As explained in the foregoing, in the four-drum system, unmatched sensitivities of four drums result in deterioration of color image quality. Therefore the deterioration of photosensitive drums is detected from the number of times of the surface potential controls. The color signals of yellow, magenta, cyan and black are given an order or priority, and, in case of an abnormality in a photosensitive drum for a color signal of low priority, a warning is given to the operator simultaneous with the corresponding color print output. In this manner it is rendered possible to avoid error in color information and to avoid a loss in time caused by unnecessary interruption of copying operation.

In this manner color image formation can be achieved with plural photosensitive members, by individually measuring the potentials thereof and judging the priority of each color in case abnormality is identified in any of said plural photosensitive members.

Although the foregoing embodiments have limited to color copying machines, the present invention is naturally not limited to such embodiment but is applicable also to any image forming apparatus which reproduces a color image on a recording material.

Also the number of photosensitive drums is not limited to four, but the present invention is applicable to any apparatus in which plural photosensitive drums are respectively employed for formation of latent images of different color components and development of visible images therefrom.

Furthermore, though the foregoing embodiments identify the abnormality in recording condition by detecting the deterioration of photosensitive members through measurement of the surface potentials thereof, the present invention is not limited to such embodiments but may also be so constructed as to detect abnormality in the toner density, in the laser unit or in the charger.

What is claimed is:

1. An image forming apparatus comprising:

plural recording means for recording plural images on the same recording material, each of said recording means comprising a photosensitive member; latent image forming means for forming an electrostatic latent image on said photosensitive member; developing means for developing said latent image formed on said photosensitive member; and transfer means for transferring a developed image on said photosensitive member onto a recording material;

detecting means for detecting a surface condition of each photosensitive member of said plural recording means; and control means for determining whether or not the surface condition is adequate in accordance with an output of said detecting means, and for controlling a recording operation of said plural recording means in accordance with a determination result of the adequacy of the surface condition, wherein said control means prohibits said recording operation in case said control means determines that the surface condition of said photosensitive member of at least one of said plural recording means is inadequate.

2. An image forming apparatus according to claim 1, wherein said plural recording means are adapted to record respectively different colors.

3. An image forming apparatus according to claim 1, wherein said surface condition is surface potential.

4. An image forming apparatus comprising:

plural recording means for recording plural images on the same recording material, each of said recording means comprising a photosensitive member; latent image forming means for forming an electrostatic latent image on said photosensitive member; developing means for developing said latent image formed on said photosensitive member; and transfer means for transferring a developed image on said photosensitive member onto a recording material;

detecting means for detecting a surface condition of said photosensitive member of one of said plural recording means;

control means for determining whether or not the surface condition is adequate in accordance with an output of said detecting means, and for controlling the recording operation of said plural recording means in accordance with a determination result of the adequacy of the surface condition, said control means being operable to give an alarm and prohibit initiation of the recording operation of said plural recording means in case said control means determines that the surface condition of said photosensitive member is inadequate; and enable means for enabling the recording operation of said recording means without regard to a determination result of said control means.

5. An image forming apparatus according to claim 4, wherein said enable means is adapted to cancel the prohibition of the recording operation by said control means.

6. An image forming apparatus according to claim 4, wherein said plural recording means are adapted to record respectively different colors.

7. An image forming apparatus according to claim 4, wherein said surface condition is surface potential.

8. An image forming apparatus comprising:

plural recording means for recording plural images on a safe recording material, said plural recording means being provided with priority for determination as to whether or not the recording operation is to be allowed;

detecting means for detecting recording condition of said plural recording means; and control means for determining as to whether or not the recording condition is adequate in accordance with an output of said detecting means, and for controlling a recording operation of said plural recording means in accordance with a determination result as to adequacy of the recording condition, wherein said control means is operable to determine, in case said control means determines that the recording condition of at least one of said plural recording means is inadequate, as to whether or not the recording operation is to be allowed, by means of identifying what recording means is under an inadequate recording condition.

9. An image forming apparatus according to claim 8, wherein said control means is adapted to prohibit said recording operation in case said control means determines that the recording condition of one of said recording means higher in priority among said plural recording means is inadequate.

10. An image forming apparatus according to claim 9, further comprising enable means for enabling the recording operation of said recording means without regard to a determination result of said control means, wherein said enable means is adapted to cancel the prohibition of the recording operation by said control means.

11. An image forming apparatus according to claim 8, wherein said plural recording means are adapted to record respectively different colors.

12. An image forming apparatus according to claim 8, wherein each of said recording means comprises a recording member; latent image forming means for forming an electrostatic latent image on said recording member; developing means for developing said latent image formed on said recording member; and transfer means for transferring a developed image on said recording member, onto a recording material.

13. An image forming apparatus according to claim 12, wherein said detecting means is adapted to detect the surface state of said recording member.

14. An image forming apparatus according to claim 13, wherein said surface state is surface potential.

* * * * *